US006899524B1

(12) United States Patent
Tangler et al.

(10) Patent No.: US 6,899,524 B1
(45) Date of Patent: May 31, 2005

(54) COOLING-TOWER FAN AIRFOILS

(75) Inventors: James L. Tangler, Boulder, CO (US); Dan M. Somers, Port Matilda, PA (US)

(73) Assignee: Midwest Research Institute, Kansas City, MO (US)

( * ) Notice: Subject to any disclaimer, the term of this patent is extended or adjusted under 35 U.S.C. 154(b) by 0 days.

(21) Appl. No.: 09/936,802

(22) PCT Filed: Jan. 21, 2000

(86) PCT No.: PCT/US00/01434

§ 371 (c)(1),
(2), (4) Date: Mar. 22, 2002

(87) PCT Pub. No.: WO00/46511

PCT Pub. Date: Aug. 10, 2000

Related U.S. Application Data

(60) Provisional application No. 60/118,985, filed on Feb. 8, 1999.

(51) Int. Cl.[7] ..... F03B 3/12

(52) U.S. Cl. ..... 416/223 R; 416/DIG. 2; 416/DIG. 5

(58) Field of Search ..... 416/223 R, 243, 416/DIG. 2, DIG. 5

(56) References Cited

U.S. PATENT DOCUMENTS

| | | | | | |
|---|---|---|---|---|---|
| 4,776,531 | A | * | 10/1988 | Noonan | 416/223 R |
| 4,911,612 | A | * | 3/1990 | Rodde et al. | 416/223 R |
| 5,417,548 | A | * | 5/1995 | Tangler et al. | 416/223 R |
| 5,562,420 | A | * | 10/1996 | Tangler et al. | 416/223 R |
| 6,039,541 | A | * | 3/2000 | Parker et al. | 416/223 R |
| 6,068,446 | A | * | 5/2000 | Tangler et al. | 416/223 R |

OTHER PUBLICATIONS

"NREL Airfoil Families for HAWTs", J.L. Tangler and D.M. Somers, National Technical Information Service, U.S. Department of Commerce, Jan. 1995.*

* cited by examiner

*Primary Examiner*—Christopher Verdier
(74) *Attorney, Agent, or Firm*—Paul J. White

(57) ABSTRACT

A family of airfoils for a blade of a cooling-tower fan, is provided wherein the blade has a root region and a tip region, the family of airfoils comprises an airfoil (30) in the root region of the blade having a Reynolds number of 500,000, and an airfoil (20) in the tip region of the blade having a Reynolds number of 1,000,000, and wherein each airfoil is characterized by a maximum lift coefficient that is largely insensitive to roughness effects.

9 Claims, 1 Drawing Sheet

COOLING-TOWER FAN AIRFOILS

CROSS REFERENCE TO RELATED PATENT APPLICATIONS

This patent application claims the benefit of U.S. Provisional Patent Application No. 60/118,985, filed on Feb. 8, 1999.

TECHNICAL FIELD

This invention relates to the field of cooling-tower fans and specifically to a family of airfoils for use on the blades of such fans.

BACKGROUND ART

Large ducted fans are commonly used in the cooling towers of electric utilities to remove heat from the cooling water of heat exchangers. These fans are made up of four to twelve blades which range from 5 to 20 feet (1.5 to 6.1 meters) in length. A standard twelve foot (3.7 meter) blade employing the NACA $63_2$-615 airfoil from root to tip has been the most commonly used blade in cooling tower applications. This airfoil has a chord thickness of 15%, and it is designed for an operating lift coefficient of 0.6 with a low-drag range that extends from a lift coefficient of 0.4 to 0.8. It was initially designed in the early 1940's for use in general aviation and has been in use over the past 50 years. As a result, certain prior art design objectives have evolved over the course of these years.

The moist environment found in cooling tower applications causes soiling and leading edge corrosion of the fan blades. These conditions result in a roughness effect that reduces the overall aerodynamic performance and efficiency of the fan. Thus, one design objective has been to improve the aerodynamic performance and reduce the sensitivity to roughness under these conditions, while operating at the maximum lift coefficient ($c_{1,\ max}$), in order to lower the power requirements on the system.

Optimization of the blade geometry and duct designs for large ducted fans would minimize the power that is required for a given thrust level or an associated pressure increase. One way to increase the thrust-to-power ratio (T/P) is to reduce the drag coefficient of the blade's airfoils to cause a reduction in the power required to drive the blade. A maximum power reduction of 5% has been associated with zero profile drag for the blade. However, because zero drag cannot be accomplished, a realistic drag loss objective could result in a 2% power reduction.

The tip airfoil should be thin enough to provide low drag, but should also provide a maximum lift-to-drag ratio (l/d) at high values of lift coefficient to minimize blade solidity. In the hub region, blade-element performance predictions have indicated the presence of low blade angles of attack. As a result, the root airfoil should produce a high lift coefficient at zero angle of attack. Designing new airfoils, having a minimal sensitivity to roughness, is therefore desirable should the blade operate in a stalled condition. Stalled conditions are usually caused either by an unsteady inflow or the low air density which is encountered when operating the fans at high temperatures.

One of the most desirable design objectives for good performance with a ducted fan is to satisfy the free-vortex flow condition. A fan satisfying the free vortex flow condition has the product of induced inplane swirl velocity and radius being constant along the span of the blade. This causes the radial pressure gradient to balance the centrifugal forces on the fluid and eliminates spanwise (radial) flow and losses due to turbulent mixing. The free-vortex condition dictates the product of local blade chord and lift coefficient. The product of these two parameters results in the necessary radial loading and the resulting fan thrust. The airfoil lift coefficient is derived for known inlet conditions of advance ratio, blade pitch, and twist angle. Therefore, either a value of lift coefficient or chord must be chosen and the other is calculated to provide an optimum combination along the span.

Near the tip region high values of lift coefficient increase the T/P ratio of the fan. Therefore, the operating lift coefficient is selected to coincide with the airfoil's best l/d ratio and the product of the lift coefficient and chord are selected in order to design the fan to a specific thrust, for a given diameter and number of blades.

Near the hub the blade requires high twist to achieve a positive angle of attack. Unlike the tip, it becomes undesirable to twist the blade root toward $c_{1,\ max}$ and the solidity or blade chord must also increase to satisfy the free-vortex condition. Special care must be taken in the design so that the solidity does not become excessive resulting in adverse "cascade" losses.

In view of the foregoing considerations there is an apparent need to satisfy the foregoing design objectives by providing an airfoil useful in a large tapered/twisted fan blade application but which has an improved aerodynamic performance over the prior art. Improvements in the aerodynamic characteristics are needed to provide an advanced airfoil having a maximum lift coefficient ($c_{1,\ max}$) that is designed to be largely insensitive to the effects of roughness and allows a lower solidity blade with lower cascade flow losses.

DISCLOSURE OF INVENTION

Accordingly, it is an object of this invention to provide an airfoil family having an improved aerodynamic performance but which demonstrates a reduced sensitivity to roughness when operating at $c_{1,\ max}$.

Another object of the invention is to provide an airfoil design that allows a lower solidity blade with lower cascade losses, lighter weight and greater cost efficiency.

It is yet another object of the invention to increase the performance gain of a fan by providing a new airfoil resulting in a 0.2 higher $c_1$ for a given airfoil angle of attack which allows an 18% blade chord reduction for a 2000 LB (8900 newton) fan thrust.

These and other objects of the present invention will become apparent throughout the description of the invention that now follows. Unless specifically defined otherwise, all technical or scientific terms used herein have the same meaning as commonly understood by one of ordinary skill in the art to which this invention belongs. Although any methods and materials similar or equivalent to those described herein can be used in the practice or testing of the present invention, the preferred methods and materials are now described.

Briefly, a family of airfoils is provided for a blade of a cooling-tower fan, wherein the blade has a root region and a tip region, the family of airfoils comprises an airfoil in the root region of the blade having a Reynolds number of 500,000, and an airfoil in the tip region of the blade having a Reynolds number of 1,000,000, and wherein each airfoil is characterized by a maximum lift coefficient that is largely insensitive to roughness effects.

Figure 1:
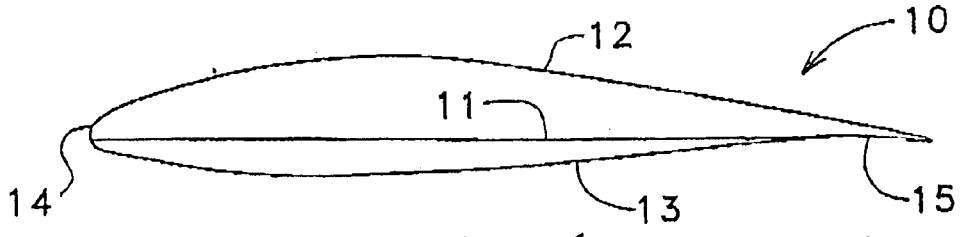
FIG. 1 (PRIOR ART)
FIG. 1 is a profile of a prior art NACA $63_2$-615 airfoil.

Best Mode for Carrying Out the Invention

I. Airfoil Performance Prediction.

An analysis method of Borst was used to assess the performance of the prior art NACA $63_2$-615 airfoil and to identify the aerodynamic improvements of the invention herein; see Borst, Henry V., "A New Blade Element Method for Calculating the Performance of High and Intermediate Solidity Axial Flow Fans," NASA-CR-3063, 1979. The Borst analysis method uses a rigid-wake model in conjunction with a cascade theory to provide a blade-element analysis method able to use two-dimensional airfoil data.

$$\sigma c_1 = 2\cos(\beta_1-\alpha_i)[\tan\beta_1-\tan(\beta_1-2\alpha_i)]\,K(x)/K(x)_{infinity} \quad \text{(Eq. 1)}$$

In Eq. 1, $\sigma$ is the local blade solidity; $c_1$ is the section lift coefficient; $\beta_1$ is the inflow angle; $\alpha_i$ is the induced angle of attack that results from wake-induced inplane swirl; x is the non-dimensional radius; and K(x) is Theodorson's circulation function. K(x) is a function of the number of blades, the wake advance ratio, and the radial position of the blade. $K(x)_{infinity}$ is Theodorson's circulation function for a fan having an infinite number of blades. The values of K(x) can be found using graphs from Borst, which were created using the rigid, helical-wake model of Gray and Wright; see Gray, Robin B., and Terry Wright, "Determination of the Design Parameters for Optimum Heavily Loaded Ducted Fans," AIAA/AHS VTOL Research, Design, and Operations Meeting, Feb. 17–19, 1969, AIAA Paper No. 69-222; Gray, Robin B., and Terry Wright, "A Vortex Wake Model for Optimum Heavily Loaded Ducted Fans," Journal of Aircraft, Vol. 7, No. 2, March-April 1970. The other main equation (Eq. 2) relates the flow angle and the induced angle to an equivalent two-dimensional angle of attack.

This method proceeds with the selection of an induced angle of attack that results for wake-induced, inplane swirl. Using this value, the values of $\sigma c_1$ are calculated using Eq. 1, directly, and Eq. 2 to find $\alpha$ for use with the two-dimensional airfoil data. The value of $\alpha_i$ is iterated upon until it results in an angle of attack and lift distribution that is compatible with the strength of the rigid-wake model. Equations 3 and 4 are then integrated to solve the blade-element equations for thrust and torque.

$$T = \tfrac{1}{2}\rho W^2 Bc(c_1\cos\phi - c_d\sin\phi) \quad \text{(Eq. 3)}$$

$$Q'/r = \tfrac{1}{2}\rho W^2 Bc(c_1\cos\phi + c_d\cos\phi) \quad \text{(Eq. 4)}$$

Certain simplifying assumptions have been associated with this method. The rigid, helical-wake assumption implies that the duct has a constant area in the axial direction and the fan is optimally loaded. The method assumes that there is no axial, induced velocity at the fan disc and that the airfoil's lift force is reacted by a pressure change. This technique also assumes that there are no duct- or hub-induced velocities.

It is further assumed that there is no flow about the blade tip or across blade stations. Therefore, secondary flow losses are not quantified. Application of the method to the invention herein also assumes that there is no acceleration or deceleration of the flow in the wake. In other words, the rotor advance ratio and the wake advance ratio were assumed to be equal.

II. Performance Characteristics and Geometry.

FIG. 1 is a profile of the prior art NACA $63_2$-615 airfoil (10). The upper surface of the airfoil (10) is shown at (12) and the lower surface at (13). The leading edge of the airfoil is at (14) and the trailing edge is at (15). The chord is shown at line (11). The NACA $63_2$-615 airfoil has a thickness of 15%.

Figure 2:
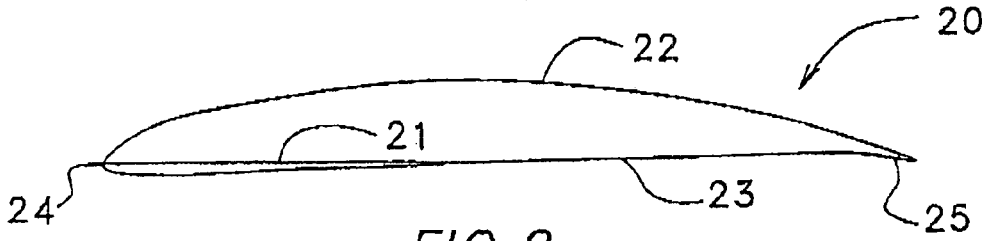
FIG. 2 is a profile of a tip airfoil according to the present invention.

FIG. 2 is a profile of the tip airfoil (20), according to the present invention, relative to the prior art NACA $63_2$-615 airfoil (10) shown in FIG. 1. The upper surface of the tip airfoil (20) is shown at (22) and the lower surface at (23). The leading edge of the tip airfoil is at (24) and the trailing edge is at (25). The chord is shown at line (21). The tip airfoil has a thickness of 10% chord.

The specific geometric tailoring of the tip airfoil (20) of FIG. 2 is given in the form of the following table of coordinates. The x/c values are dimensionless locations along the blade chord line (21). They are given for both the upper (22) and lower (23) surfaces. The y/c values, are the dimensionless heights from the chord line (21) to points either on the upper or lower surface.

| TIP AIRFOIL 10% | |
|---|---|
| x/c | y/c |
| UPPER SURFACE | |
| 1.00000 | 0.00000 |
| 0.99670 | 0.00088 |
| 0.98716 | 0.00373 |
| 0.97222 | 0.00863 |
| 0.95269 | 0.01521 |
| 0.92905 | 0.02278 |
| 0.90137 | 0.03076 |
| 0.86962 | 0.03901 |
| 0.83410 | 0.04761 |
| 0.79539 | 0.05651 |
| 0.75405 | 0.06552 |
| 0.71067 | 0.07440 |
| 0.66582 | 0.08287 |
| 0.62009 | 0.09058 |
| 0.57397 | 0.09708 |
| 0.52766 | 0.10192 |
| 0.48128 | 0.10496 |
| 0.43504 | 0.10625 |
| 0.38928 | 0.10586 |
| 0.34435 | 0.10391 |
| 0.30064 | 0.10051 |
| 0.25854 | 0.09581 |
| 0.21849 | 0.08997 |
| 0.18089 | 0.08313 |
| 0.14614 | 0.07541 |
| 0.11457 | 0.06695 |
| 0.08648 | 0.05789 |
| 0.06211 | 0.04839 |
| 0.04163 | 0.03863 |
| 0.02516 | 0.02886 |
| 0.01280 | 0.01937 |
| 0.00455 | 0.01054 |
| 0.00047 | 0.00297 |
| 0.00003 | 0.00066 |
| LOWER SURFACE | |
| 0.00004 | −0.00070 |
| 0.00037 | −0.00179 |
| 0.00120 | −0.00266 |
| 0.00254 | −0.00346 |
| 0.00771 | −0.00536 |
| 0.02065 | −0.00762 |
| 0.03926 | −0.00898 |
| 0.06332 | −0.00945 |
| 0.09261 | −0.00909 |
| 0.12682 | −0.00800 |

-continued

| TIP AIRFOIL 10% | |
|---|---|
| x/c | y/c |
| 0.16562 | −0.00627 |
| 0.20860 | −0.00402 |
| 0.25530 | −0.00138 |
| 0.30519 | 0.00152 |
| 0.35772 | 0.00455 |
| 0.41227 | 0.00755 |
| 0.46821 | 0.01041 |
| 0.52486 | 0.01296 |
| 0.58152 | 0.01510 |
| 0.63745 | 0.01667 |
| 0.69190 | 0.01759 |
| 0.74412 | 0.01779 |
| 0.79336 | 0.01725 |
| 0.83888 | 0.01593 |
| 0.87997 | 0.01390 |
| 0.91590 | 0.01120 |
| 0.94594 | 0.00809 |
| 0.96955 | 0.00501 |
| 0.98647 | 0.00240 |
| 0.99662 | 0.00063 |
| 1.00000 | 0.00000 |

Figure 3:
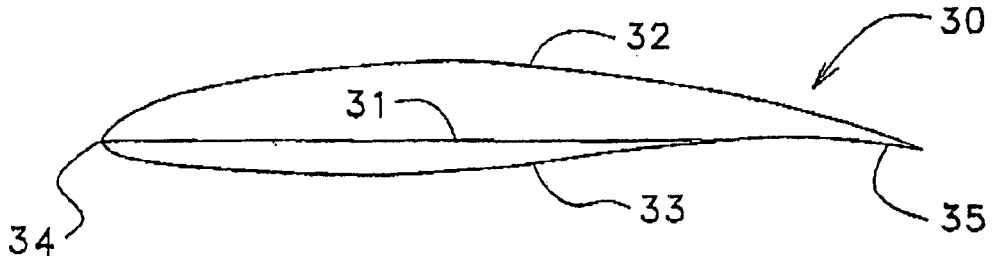
FIG. 3 is a profile of a root airfoil according to the present invention.

FIG. 3 is a profile of the root airfoil (30), according to the present invention, relative to the prior art NACA $63_2$-615 airfoil (10) shown in FIG. 1. The upper surface of the root airfoil is shown at (32) and the lower surface at (33). The leading edge of the root airfoil is at (34) and the trailing edge is at (35). The root airfoil has a thickness of 14% chord.

The specific geometric tailoring of the root airfoil (30) of FIG. 3 is given in the form of the following table of coordinates. The x/c values are dimensionless locations along the blade chord line (31). They are given for both the upper (32) and lower (33) surfaces. The y/c values are the dimensionless heights from the chord line (31) to points either on the upper or lower surface.

| ROOT AIRFOIL 14% | |
|---|---|
| x/c | y/c |
| UPPER SURFACE | |
| 1.00000 | 0.00000 |
| 0.99662 | 0.00114 |
| 0.98703 | 0.00476 |
| 0.97233 | 0.01078 |
| 0.95346 | 0.01852 |
| 0.93085 | 0.02701 |
| 0.90436 | 0.03546 |
| 0.87375 | 0.04370 |
| 0.83919 | 0.05188 |
| 0.80116 | 0.05998 |
| 0.76012 | 0.06785 |
| 0.71657 | 0.07535 |
| 0.67101 | 0.08232 |
| 0.62395 | 0.08859 |
| 0.57590 | 0.09397 |
| 0.52735 | 0.09831 |
| 0.47876 | 0.10147 |
| 0.43059 | 0.10333 |
| 0.38330 | 0.10381 |
| 0.33728 | 0.10284 |
| 0.29293 | 0.10039 |
| 0.25059 | 0.09648 |
| 0.21061 | 0.09119 |
| 0.17330 | 0.08462 |
| 0.13897 | 0.07691 |
| 0.10792 | 0.06822 |

-continued

| ROOT AIRFOIL 14% | |
|---|---|
| x/c | y/c |
| 0.08040 | 0.05875 |
| 0.05665 | 0.04869 |
| 0.03685 | 0.03828 |
| 0.02116 | 0.02780 |
| 0.00968 | 0.01758 |
| 0.00256 | 0.00808 |
| 0.00019 | 0.00179 |
| LOWER SURFACE | |
| 0.00000 | −0.00004 |
| 0.00021 | −0.00165 |
| 0.00093 | −0.00316 |
| 0.00215 | −0.00470 |
| 0.00374 | −0.00627 |
| 0.01354 | −0.01266 |
| 0.02846 | −0.01889 |
| 0.04821 | −0.02465 |
| 0.07252 | −0.02979 |
| 0.10113 | −0.03414 |
| 0.13371 | −0.03759 |
| 0.16991 | −0.04003 |
| 0.20931 | −0.04131 |
| 0.25153 | −0.04120 |
| 0.29632 | −0.03951 |
| 0.34354 | −0.03619 |
| 0.39294 | −0.03140 |
| 0.44418 | −0.02524 |
| 0.49710 | −0.01784 |
| 0.55160 | −0.00978 |
| 0.60714 | −0.00186 |
| 0.66285 | 0.00525 |
| 0.71775 | 0.01102 |
| 0.77079 | 0.01508 |
| 0.82084 | 0.01719 |
| 0.86679 | 0.01718 |
| 0.90735 | 0.01506 |
| 0.94113 | 0.01136 |
| 0.96729 | 0.00713 |
| 0.98565 | 0.00340 |
| 0.99645 | 0.00088 |
| 1.00000 | 0.00000 |

INDUSTRIAL APPLICABILITY

Table 1 summarizes the predicted performance characteristics for these new airfoils relative to the baseline prior art NACA $63_2$-615 airfoil.

| Airfoil | NACA $63_2$–615 (tip airfoil/root airfoil) | S905 (tip airfoil) | S904 (root airfoil) |
|---|---|---|---|
| Station Reynolds Number | 1,000,000/500,000 | 1,000,000 | 500,000 |
| Thickness Ratio | 15%/15% | 10% | 14% |
| $C_{1,max}$ | 1.25/1.20 | 1.50 | 1.50 |
| $C_1$ at 0 angle of attack | 0.536/0.536 | 0.745 | 0.723 |
| $C_1$ at lower limit of low-drag range | 0.20/0.20 | 0.65 | 0.05 |
| $C_1$ at upper limit of low-drag range | 1.20/1.20 | 1.20 | 1.15 |
| Drag coefficient at design $c_1$ | 0.009/0.010 | 0.007 | 0.008 |

In Table 1, the tip airfoil has less thickness than the baseline NACA $63_2$-615 (10% versus 15%). This reduction in thickness results in a lower minimum drag (0.007 versus 0.009). At the design Reynolds number, the tip airfoil also has a higher $c_{1,\ max}$ (1.50 versus 1.256). The root airfoil is slightly thinner than the NACA $63_2$-615 and has less drag in the root region (0.008 versus 0.010). It also has a larger $c_1$ at zero angle of attack and a greater $c_{1,\,max}$. These improvements will lead to better performance in the root region.

Fan performance was calculated with the tip and the root airfoils using the baseline blade taper and twist geometry for the design thrust of 2000 LB (8900 newton). The airfoils of the invention can be used for fans having individual blades ranging from 3 to 10 meters in length. For the baseline blade the 2000 LB (8900 newton) thrust is achieved at a geometric pitch angle of 2° versus 0° for the new airfoils. For these geometric blade-pitch angles, the new airfoils result in a performance gain of 1.5% for an eight-bladed 28-foot (8.534-meter) diameter fan. This gain does not take into account the gain that would be attributable to the airfoil's improved insensitivity to roughness where some measure of improvement is expected. It should be noted that the geometric pitch angle is with respect to the airfoil chord line which differs from a field pitch angle setting that is normally with respect to the lower surface of the airfoil. For the NACA $63_2$-615 airfoil the field pitch setting is 4° greater than the geometric pitch angle.

Further gain is achieved by using the new airfoils with less blade chord than the baseline blade. The new airfoils are designed to operate at a 0.2 higher $c_1$ than the baseline NACA $63_2$-615 airfoil for a given blade pitch angle. One degree of blade pitch is equivalent to 0.1 $c_1$. This means that the new airfoils allow the blade chord to be reduced 18% by increasing the blade geometric pitch from 0° to 2° to satisfy the design thrust requirement of 2000 LB (8900 newton). The advantage of this tradeoff is that less blade chord results in less dimensional blade drag and the higher pitch angle still lies well within the airfoil's low-drag range. It is also predicted that this chord reduction will increase the performance gain to 1.8% at the 2000 LB (8900 newton) design thrust.

A similar reduction in chord to 82% for the baseline blade with the NACA $63_2$-615 airfoil requires a blade pitch of 4° to achieve the 2000 LB (8900 newton) thrust. This results in a small performance gain relative to the baseline blade of 0.4%. The pitch increase from 2° to 4° is undesirable since it results in a noticeable reduction in the pitch margin to stall where fluctuating loads due to inflow variability become a problem.

An additional advantage using 18% less chord with the new airfoils is lower "cascade" losses due to reduced aerodynamic interference in the root region from lower solidity and corresponding lower blade weight and cost.

The foregoing description is considered as illustrative only of the principles of the invention. Furthermore, since numerous modifications and changes will readily occur to those skilled in the art, it is not desired to limit the invention to the exact construction and process shown as described above. Accordingly, all suitable modifications and equivalents may be resorted to falling within the scope of the invention as defined by the claims which follow.

What is claimed is:

1. A family of airfoils for a blade of a cooling-tower fan, wherein the blade has a root region and a tip region, the family of airfoils comprising an airfoil in the root region of the blade having a Reynolds number of 500,000, and an airfoil in the tip region of the blade having a Reynolds number of 1,000,000, wherein the airfoil in the tip region has a maximum lift coefficient of about 1.5 and the airfoil in the root region has a maximum lift coefficient of about 1.5, and wherein each airfoil is characterized by a maximum lift coefficient that is largely insensitive to roughness effects.

2. The family of airfoils of claim 1, wherein the blade has a length in a range of 3 to 10 meters.

3. The family of airfoils of claim 1, wherein the tip-region airfoil has a thickness of about 10% chord and the root region airfoil has a thickness of about 14% chord.

4. An airfoil for a blade of a cooling-tower fan wherein the blade has a root region airfoil having a cross-sectional shape characterized by a thickness of about 14% chord and a maximum lift coefficient of about 1.5 to be substantially insensitive to roughness, and a Reynolds number of 500,000.

5. The airfoil of claim 4, wherein the blade is 3 to 10 meters in length.

6. An airfoil for a blade of a cooling-tower fan wherein the blade has a root region airfoil comprising an upper surface and a lower surface and a blade chord line wherein x/c values are dimensionless locations along the blade chord line and y/c values are dimensionless heights from the chord line to points on the upper or lower surface, wherein said values correspond substantially to the following table for said surfaces:

| x/c | y/c |
|---|---|
| UPPER SURFACE | |
| 1.00000 | 0.00000 |
| 0.99662 | 0.00114 |
| 0.98703 | 0.00476 |
| 0.97233 | 0.01078 |
| 0.95346 | 0.01852 |
| 0.93085 | 0.02701 |
| 0.90436 | 0.03546 |
| 0.87375 | 0.04370 |
| 0.83919 | 0.05188 |
| 0.80116 | 0.05998 |
| 0.76012 | 0.06785 |
| 0.71657 | 0.07535 |
| 0.67101 | 0.08232 |
| 0.62395 | 0.08859 |
| 0.57590 | 0.09397 |
| 0.52735 | 0.09831 |
| 0.47876 | 0.10147 |
| 0.43059 | 0.10333 |
| 0.38330 | 0.10381 |
| 0.33728 | 0.10284 |
| 0.29293 | 0.10039 |
| 0.25059 | 0.09648 |
| 0.21061 | 0.09119 |
| 0.17330 | 0.08462 |
| 0.13897 | 0.07691 |
| 0.10792 | 0.06822 |
| 0.08040 | 0.05875 |
| 0.05665 | 0.04869 |
| 0.03685 | 0.03828 |
| 0.02116 | 0.02780 |
| 0.00968 | 0.01758 |
| 0.00256 | 0.00808 |
| 0.00019 | 0.00179 |
| LOWER SURFACE | |
| 0.00000 | −0.00004 |
| 0.00021 | −0.00165 |
| 0.00093 | −0.00316 |
| 0.00215 | −0.00470 |
| 0.00374 | −0.00627 |
| 0.01354 | −0.01266 |
| 0.02846 | −0.01889 |
| 0.04821 | −0.02465 |
| 0.07252 | −0.02979 |
| 0.10113 | −0.03414 |
| 0.13371 | −0.03759 |
| 0.16991 | −0.04003 |
| 0.20931 | −0.04131 |

-continued

| x/c | y/c |
|---|---|
| 0.25153 | −0.04120 |
| 0.29632 | −0.03951 |
| 0.34353 | −0.03619 |
| 0.39294 | −0.03140 |
| 0.44418 | −0.02524 |
| 0.49710 | −0.01784 |
| 0.55160 | −0.00978 |
| 0.60714 | −0.00186 |
| 0.66285 | 0.00525 |
| 0.71775 | 0.01102 |
| 0.77079 | 0.01508 |
| 0.82084 | 0.01719 |
| 0.86679 | 0.01718 |
| 0.90735 | 0.01506 |
| 0.94113 | 0.01136 |
| 0.96729 | 0.00713 |
| 0.98565 | 0.00340 |
| 0.99645 | 0.00088 |
| 1.00000 | 0.00000. |

7. An airfoil for a blade of a cooling-tower fan wherein the blade has a tip region airfoil having a cross-sectional shape characterized by a thickness of about 10% chord and a maximum lift coefficient of about 1.5 to be substantially insensitive to roughness, and a Reynolds number of 1,000,000.

8. The tip region airfoil of claim 7 wherein the blade is 3 to 10 meters in length.

9. An airfoil for a blade of a cooling-tower fan wherein the blade has a tip region airfoil comprising an upper surface and a lower surface and a blade chord line wherein x/c values are dimensionless locations along the blade chord line and y/c values are dimensionless heights from the chord line to points on the upper or lower surface, wherein said values correspond substantially to the following table for said surfaces:

| x/c | y/c |
|---|---|
| UPPER SURFACE | |
| 1.00000 | 0.00000 |
| 0.99670 | 0.00088 |
| 0.98716 | 0.00373 |
| 0.97222 | 0.00863 |
| 0.95269 | 0.01521 |
| 0.92905 | 0.02278 |
| 0.90137 | 0.03076 |
| 0.86962 | 0.03901 |
| 0.83410 | 0.04761 |
| 0.79539 | 0.05651 |
| 0.75405 | 0.06552 |
| 0.71067 | 0.07440 |

-continued

| x/c | y/c |
|---|---|
| 0.66582 | 0.08287 |
| 0.62009 | 0.09058 |
| 0.57397 | 0.09708 |
| 0.52766 | 0.10192 |
| 0.48128 | 0.10496 |
| 0.43504 | 0.10625 |
| 0.38928 | 0.10586 |
| 0.34435 | 0.10391 |
| 0.30064 | 0.10051 |
| 0.25854 | 0.09581 |
| 0.21849 | 0.08997 |
| 0.18089 | 0.08313 |
| 0.14614 | 0.07541 |
| 0.11457 | 0.06695 |
| 0.08648 | 0.05789 |
| 0.06211 | 0.04839 |
| 0.04163 | 0.03863 |
| 0.02516 | 0.02886 |
| 0.01280 | 0.01937 |
| 0.00455 | 0.01054 |
| 0.00047 | 0.00297 |
| 0.00003 | 0.00066 |
| LOWER SURFACE | |
| 0.00004 | −0.00070 |
| 0.00037 | −0.00179 |
| 0.00120 | −0.00266 |
| 0.00254 | −0.00346 |
| 0.00771 | −0.00536 |
| 0.02065 | −0.00762 |
| 0.03926 | −0.00898 |
| 0.06332 | −0.00945 |
| 0.09261 | −0.00909 |
| 0.12682 | −0.00800 |
| 0.16562 | −0.00627 |
| 0.20860 | −0.00402 |
| 0.25530 | −0.00138 |
| 0.30519 | 0.00152 |
| 0.35772 | 0.00455 |
| 0.41227 | 0.00755 |
| 0.46821 | 0.01041 |
| 0.52486 | 0.01296 |
| 0.58152 | 0.01510 |
| 0.63745 | 0.01667 |
| 0.69190 | 0.01759 |
| 0.74412 | 0.01779 |
| 0.79336 | 0.01725 |
| 0.83888 | 0.01593 |
| 0.87997 | 0.01390 |
| 0.91590 | 0.01120 |
| 0.94594 | 0.00809 |
| 0.96955 | 0.00501 |
| 0.98647 | 0.00240 |
| 0.99662 | 0.00063 |
| 1.00000 | 0.00000. |

* * * * *

UNITED STATES PATENT AND TRADEMARK OFFICE

CERTIFICATE OF CORRECTION

PATENT NO. : 6,899,524 B1 
DATED : May 31, 2005
INVENTOR(S) : James L. Tangler and Dan M. Somers It is certified that error appears in the above-identified patent and that said Letters Patent is hereby corrected as shown below:

Column 1,
Line 6, insert as first paragraph the following:

-- Contractural Origin:

The United States Government has rights in this invention under Contract No. DE-AC36-99GO10337 between the U.S. Department of Energy and the National Renewable Energy Laboratory, a Division of the Midwest Research Institute. --.

Signed and Sealed this

Eleventh Day of October, 2005

JON W. DUDAS
*Director of the United States Patent and Trademark Office*